US006431392B1

(12) United States Patent
Eisenbeisz

(10) Patent No.: US 6,431,392 B1
(45) Date of Patent: Aug. 13, 2002

(54) ADJUSTABLE PAINT TRAY CARRIER APPARATUS AND METHOD

(76) Inventor: Donald G. Eisenbeisz, 15903 76th Pl. NE., Kenmore, WA (US) 98028

( * ) Notice: Subject to any disclaimer, the term of this patent is extended or adjusted under 35 U.S.C. 154(b) by 173 days.

(21) Appl. No.: 09/633,178

(22) Filed: Aug. 4, 2000

Related U.S. Application Data

(60) Provisional application No. 60/147,754, filed on Aug. 6, 1999.

(51) Int. Cl.[7] ..... B65D 25/00

(52) U.S. Cl. ..... 220/759; 220/737; D32/53.1

(58) Field of Search ..... 220/759, 570, 220/737, 743; 294/28, 32, 34; D32/53.1

(56) References Cited

U.S. PATENT DOCUMENTS

| | | | | |
|---|---|---|---|---|
| 1,772,392 A | * | 8/1930 | Firl | |
| 2,698,450 A | * | 1/1955 | Mack | 15/121.1 |
| 3,083,886 A | * | 4/1963 | Fry | 220/759 X |
| 3,575,455 A | | 4/1971 | Block | |
| 3,593,951 A | * | 7/1971 | Warner et al. | 220/570 X |
| 3,641,616 A | * | 2/1972 | Bonci | 15/257.06 |
| 3,731,840 A | | 5/1973 | Beutler et al. | |
| 3,837,034 A | | 9/1974 | Leffert et al. | |
| 3,940,824 A | | 3/1976 | Gioia et al. | |
| 4,023,702 A | | 5/1977 | McKnight | |
| 4,085,877 A | | 4/1978 | Hildebrand | |
| 4,205,411 A | | 6/1980 | Cupp et al. | |
| D297,676 S | | 9/1988 | Ross et al. | |
| D321,070 S | | 10/1991 | Lewicki | |
| 5,113,549 A | | 5/1992 | Villiano | |
| 5,201,439 A | | 4/1993 | Davies | |
| D349,376 S | | 8/1994 | Hankey, Sr. | |
| 5,511,279 A | | 4/1996 | Ippolito | |
| D383,579 S | | 9/1997 | Samson | |
| 5,799,819 A | * | 9/1998 | Nimer | 220/737 X |

* cited by examiner

*Primary Examiner*—Steven Pollard
(74) *Attorney, Agent, or Firm*—William Forster

(57) ABSTRACT

An adjustable paint tray carrier is provided for carrying and transporting a paint tray of the type having substantially parallel, vertically disposed, opposing spaced-apart side walls that define an upper perimeter lip. The paint tray carrier comprises a first support arm that includes an upper supported end, a spaced-apart lower fastening end and a body disposed therebetween. Similarly an opposing second support arm is provided that includes an upper supported end, a spaced-apart lower fastening end and a body disposed therebetween. Additionally, the first support arm is pivotally connected to the second support arm to allow relative pivotal movement so that the distance between the lower fastening ends of the opposing support arms is variable. To facilitate the connection of each support arm to a side wall of a paint tray, a clamp is disposed on the lower fastening end of each support arm. Each support arm is relatively pivotable from a first closed compact position where the lower fastening ends of the support arms are adjacently disposed, to a second open spread-apart position where each fastening end is disposed adjacent an opposing side wall of the paint tray. Accordingly, the clamp of each support arm can engage a respective side wall to secure the paint tray carrier to the paint tray.

20 Claims, 7 Drawing Sheets

FIG. 3
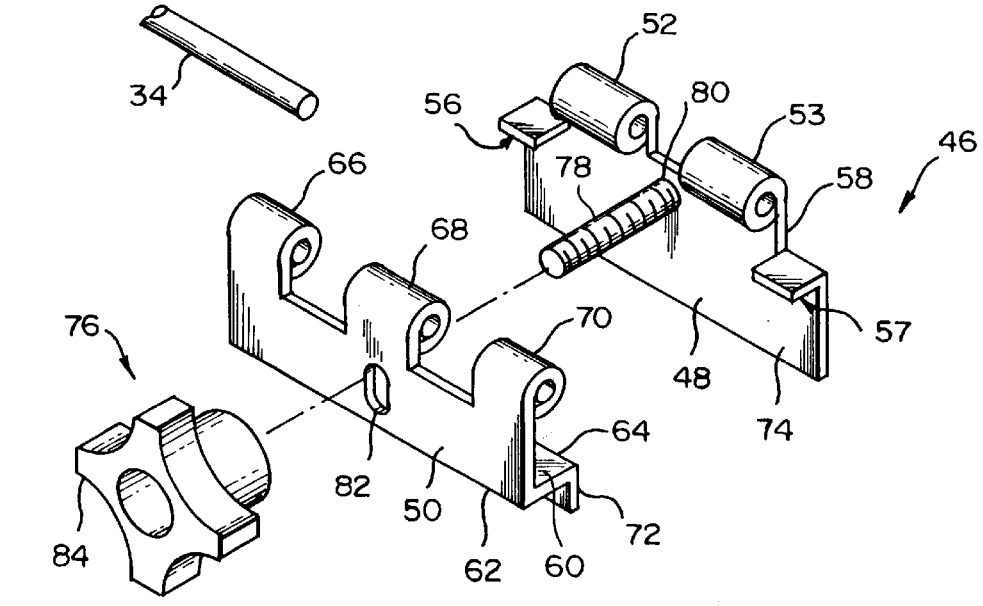
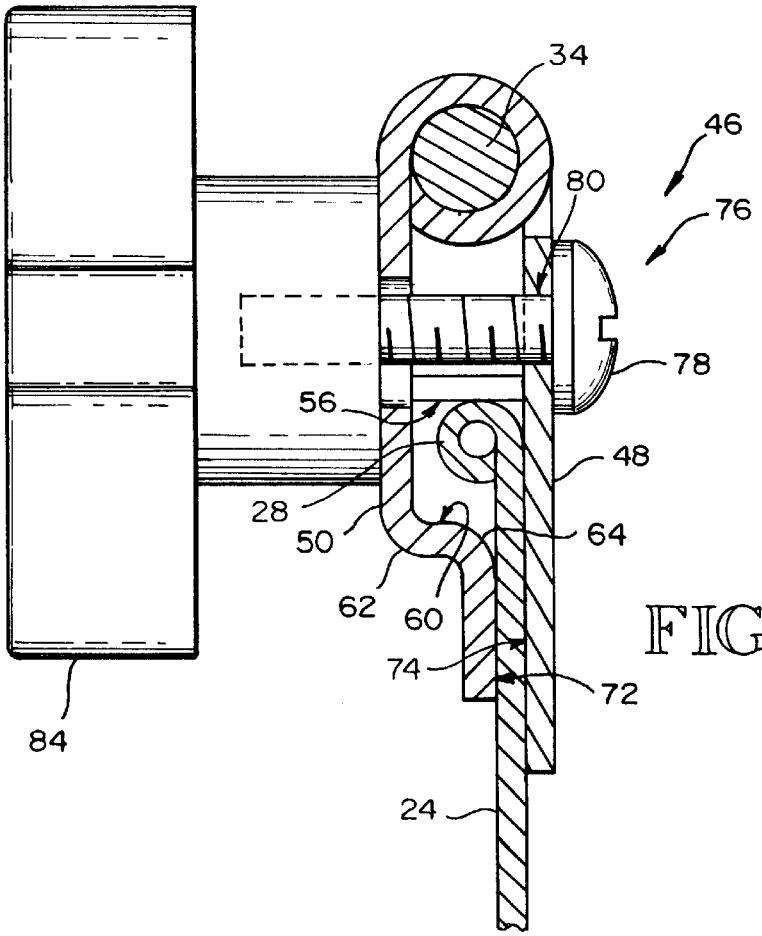
FIG. 4

ADJUSTABLE PAINT TRAY CARRIER APPARATUS AND METHOD

This application claims the benefit of U.S. Provisional Application No. 60/147,754 Filed Aug. 6, 1999.

BACKGROUND

This invention relates generally to painting accessories, and more particularly to an apparatus and method for carrying a paint tray.

Devices provided for carrying paint trays are known in the art. A number of paint tray carriers have been invented wherein some operate with common, readily available paint trays, while others are formed integrally with the tray carrier designed to work only with one specific unique paint tray. For example U.S. Pat. Nos. 3,575,455; 3,731,843; 4,085,877; 4,023,702; Des. 297,676; Des. 321,070; 5,113,549 and Des 349,376 are designed to be attached to standard readily available alike paint trays. Importantly, it should be noted that none of these tray carriers are designed to accommodate paint trays of varying width, or to easily fold into a compact shape.

In contrast, U.S. Pat. Nos. 3,637,034; 3,940;824; 4,205,411; 5,201,439; 5,511,279; and Des. 383,579 are specially designed tray carriers that are not adaptable for use with standard shaped paint trays. Accordingly, these designs do not adapt to other paint trays of varying width, and typically do not fold to a compact storage configuration.

While most the above noted paint tray carriers adequately perform the task of carrying a tray of paint, they generally lack either the adaptability to work with standard paint trays of varying width, or alternatively, their special design prevents operation with standard paint trays.

Accordingly, a need remains for a simple adjustable paint tray carrier that can adjust or fold from a compact position to an open position to accommodate engagement with the sidewalls of paint trays of the type where the spacing between opposing sidewalls varies from one paint tray to another as with small and large paint trays.

SUMMARY

One object of the present invention is to enable the user thereof to easily and quickly carry a loaded paint tray to and from multiple work locations.

A second object is to reduce the amount of paint spilled when moving a full paint tray.

Another object is to reduce the cleanup time necessary following a painter's work.

Yet another object is to increase the efficiency of painters.

A further object is to enable a painter to easily carry a paint tray without impeding the painter's use of the tray.

Still another object is to enable a painter to easily handle and carry paint trays of varying widths.

The invention is an adjustable paint tray carrier. The paint tray carrier is provided for carrying and transporting a paint tray of the type having substantially parallel, vertically disposed, opposing spaced-apart side walls that define an upper perimeter lip. Primarily, the paint tray carrier comprises a first support arm that includes an upper supported end, a spaced-apart lower fastening end and a body disposed therebetween. Similarly an opposing second support arm is provided that includes an upper supported end, a spaced-apart lower fastening end and a body disposed therebetween. Additionally, the first support arm is pivotally connected to the second support arm to allow relative pivotal movement. In this way the distance between the lower fastening ends of the opposing support arms is variable.

In order to connect each support arm to a side wall of a paint tray, a clamp is disposed on the lower fastening end of each support arm. Importantly, the support arms are relatively pivotable from a first closed compact position where the lower fastening ends of the support arms are adjacently disposed, to a second open spread-apart position where each fastening end is disposed adjacent an opposing side wall of the paint tray. In this way, the clamp of each support arm can engage a respective side wall to secure the paint tray carrier to the paint tray. With this configuration, a user can grasp the supported ends of the support arms thereby easily moving the attached "filled" paint tray to a desired location.

In accordance with another aspect of the invention, a spring clamp is employed, in combination with a biasing cam. A spring clamp would typically include an outer leg that opposes an inner leg, wherein the legs are normally sprung apart to receive a sidewall therebetween. With this construction, the biasing cam, and therefore the cam surface thereof can move from a first position where it exerts little biasing pressure, and where the spring clamp is in a first open position to receive a side wall of the paint tray therebetween, to a second position where the biasing cam exerts maximum biasing pressure, and where the spring clamp is moved to the second closed clamping position where an outer leg and an inner leg come together to apply clamping pressure to the respective side wall to secure the same to the paint tray carrier.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

FIG. 3 is an exploded fragmentary perspective view illustrating the components of a clamp provided in accordance with the present invention.

FIG. 4 is a fragmentary cross-sectional view taken along 4—4 illustrating a preferred embodiment clamp engaging a side wall of a paint tray.

DETAILED DESCRIPTION OF PREFERRED EMBODIMENT

Figure 1:
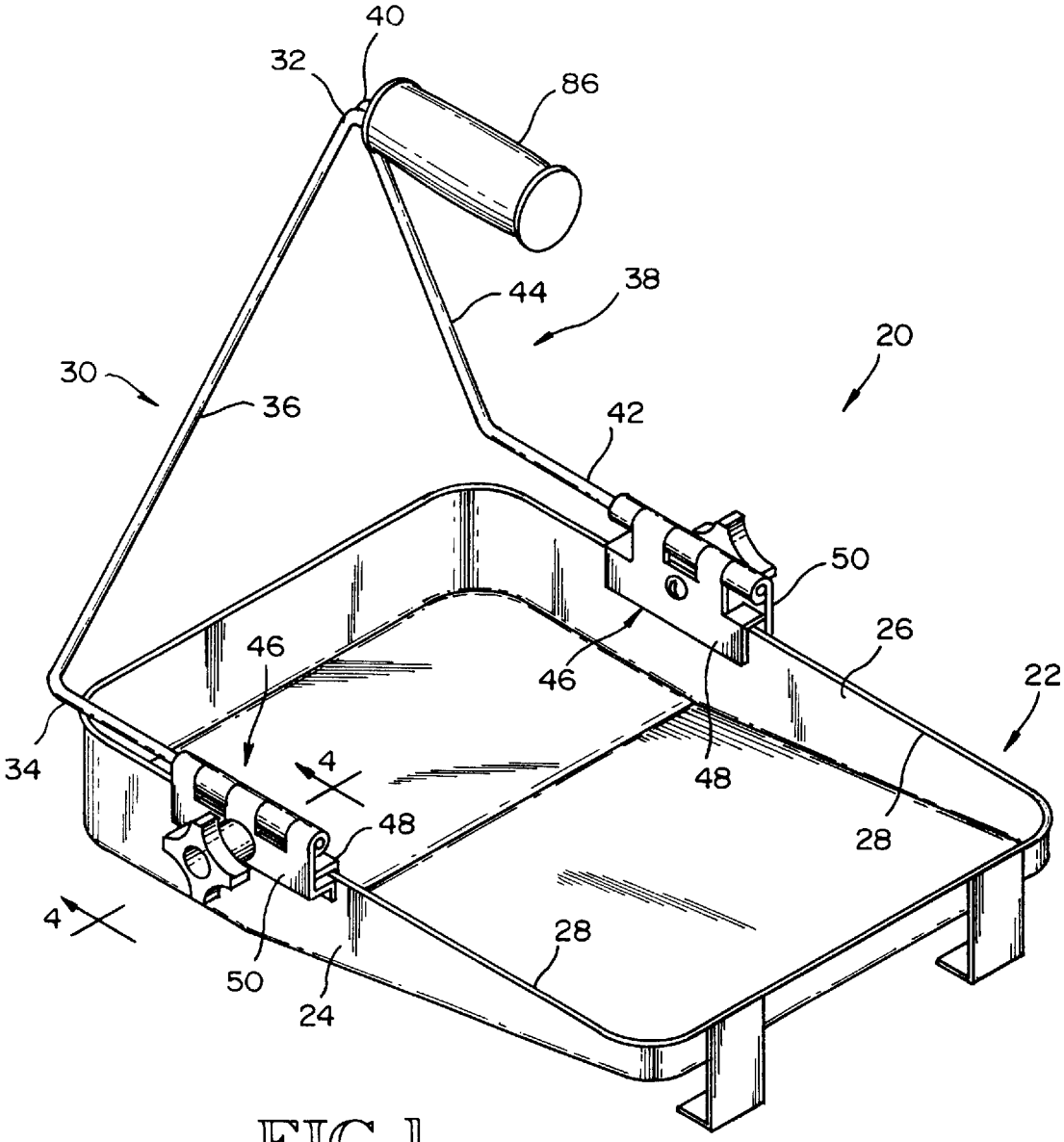
FIG. 1 is a frontal perspective view illustrating a preferred embodiment paint tray carrier mounted to the side walls of a paint tray.

Referring now to the drawings, and first to FIGS. 1 through 4, shown generally at 20 is a paint tray carrier constructed in accordance with the present invention. The paint tray carrier 20 is provided for carrying and transporting a paint tray 22 of the type having substantially parallel, vertically disposed, opposing spaced-apart side walls 24, 26 that define an upper perimeter lip 28. Primarily, the paint tray carrier 20 comprises a first support arm 30 that includes an upper supported end 32, a spaced-apart lower fastening end 34 and a body 36 disposed therebetween. Similarly an opposing second support arm 38 is provided that includes an upper supported end 40, a spaced-apart lower fastening end 42 and a body 44 disposed therebetween. Additionally, the first support arm 30 is pivotally connected to the second support arm 38 to allow relative pivotal movement. In this way the distance between the lower fastening ends 34, 42 of the opposing first and second support arms 30, 38 is variable.

In order to connect each support arm 30, 38 to the respective side wall of a paint tray 22, a clamp 46 is disposed on the lower fastening end of each support arm 30, 38. Importantly, the support arms 30, 38 are relatively pivotable from a first closed compact position where the fastening ends of the support arms 30, 38 are adjacently disposed (FIG. 2), to a second open spread-apart position where each lower fastening end 34, 42 is disposed adjacent an opposing side wall 24, 26 of the paint tray 22. In this way, the clamp 46 of each support arm 30, 38 can engage a respective side wall to secure the paint tray carrier 20 to the paint tray 22. With this configuration, a user can grasp the upper supported ends 32, 40 of the first and second support arms 30, 38 thereby moving the attached paint tray, and paint therein (not illustrated), to a desired location. Additionally, it should be noted that the first closed compact position, where opposing clamp(s) 46 of each first and second support arm 30, 38 are brought close together and/or in contact, allow the user to easily store the paint tray carrier 20. Additionally, the pivotable feature of the support arms of the paint tray carrier 20 enables the same to be engaged with a plurality of paint trays of varying width.

Considering now in more detail, the structure of the components from which a paint tray carrier 20 is constructed, each lower fastening end 34, 42 of the first and second support arms 30, 38 include a clamp 46. Each clamp 46 is constructed alike. With this configuration, a user can attach the paint tray carrier 20 to the side walls 24, 26 of the paint tray 22 so that the same can easily and safely be moved to various locations without spilling the paint contained therein. In addition, this configuration allows the user to adjust the placement of the paint tray carrier 20 to a plurality of locations along the side walls 24, 26 thereby compensating for a center of gravity that may change according to the level of contents within the paint tray 22.

In the preferred embodiment, each clamp 46 is constructed from a common door hinge readily available from many sources. As explained below, such door hinges can be modified slightly for use in the present invention. Because of this construction, each support arm 30, 38 is manufactured of ¼ inch diameter round metal rod. In this way, each lower fastening end 34, 42 can be disposed to perform the function of the "hinge pivot pin" (not illustrated) that comes with the original door hinge. Accordingly, the lower fastening ends 34, 42 are disposed to pivotally couple the two primary components of the clamp 46 together.

Figure 2:
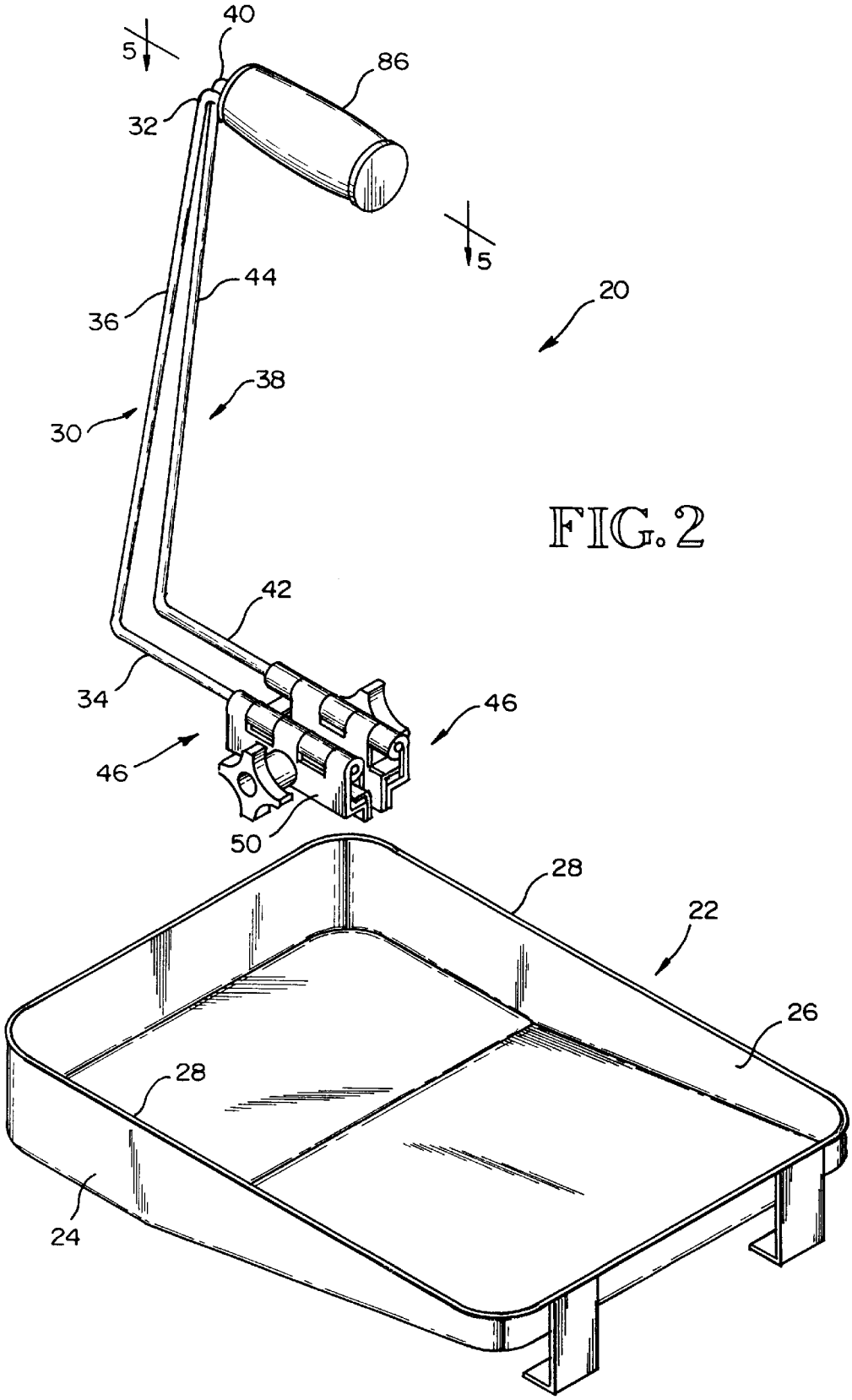
FIG. 2 is a perspective view of a paint tray carrier disengaged from a paint tray, the paint tray carrier being folded to the closed compact position where the fastening ends of the support arms are adjacently disposed.

More specifically, the clamp 46 comprises opposing hinge plates, i.e., an inside hinge plate 48 and an outside hinge plate 50. As noted above, the original "hinge pivot pin", provided with the door hinge, is removed and replaced by the lower fastening ends 24, 32 after the hinge plates have been modified. Directing attention to FIGS. 3 and 4, an inside hinge plate 48 comprises two alike pin receiving supports 52, 53. Additionally, the inside hinge plate 48 is modified to define two symmetrically disposed alike, horizontal stop surfaces 56, 57. This is accomplished by cutting a portion of each inside hinge plate 48. For example, a cut is made to form cut surface 58, to the outside of pin receiving support 52. By making this cut, the metal can be bent to a 90 degree angle as best illustrated in FIG. 3. The stop surfaces 56, 57 are provided on either side of the pin receiving supports to properly position each clamp 46 on the respective side wall. This is illustrated in FIGS. 1, 2 and 4 where the stop surfaces 56, 57 are shown resting on the lip 28 of the paint tray 22. As will be more fully discussed below, the stop surfaces 56, 57 also prevent the tray lip 28 from contacting a bolt 78 used for biasing the clamp 46 against the side wall of the paint tray 22.

Similarly, the outside hinge plate 50 is modified to form a step that defines a lip support surface 60. As illustrated in FIGS. 3 and 4, the lip support surface 60 is formed by a first 90 degree bend that forms edge 62, and a second 90 degree bend to form edge 64. These bends in the outside hinge plate 50 are arranged so that an assembled clamp 46 can fit over the lip 28 such that the same is disposed between the stop surfaces 56, 57 and the lip support surface 60. The lip support surface 60 is provided to prevent the paint tray 22 from disengaging the clamps 46 should the same become "unbiased" or if a sudden load is placed thereon. If such a situation were to arise, the lip 28 would prevent the lip support surface 60 from sliding upward causing the clamp 46 to slide off the respective side wall.

Similar to the inside hinge plate 48, the outside hinge plate 50 comprises a plurality of pin receiving supports: 66, 68 and 70. The same are offset so that the two opposing hinge plates can fit together to form the clamp 46. Further, as illustrated in FIG. 4, a cross section of an assembled clamp 46 is shown engaging the side wall of a paint tray 22. As can be seen, each hinge plate 48, 50 is arranged so that the resulting clamp 46 comprises opposing clamping surfaces 72, 74 which are substantially parallel to side walls 24, 26. This arrangement is provided by the modifications to the hinge plates as noted above.

Beyond this, the inside and outside hinge plates 48, 50 pivot about a fastening end of a side arm so that the clamp 46 can engage the side wall of a paint tray 22 as well as be properly aligned thereto during the biasing of clamp 46 as noted below. For this purpose, a biasing member 76 is provided. In the preferred embodiment, the biasing member 76 comprises a common bolt 78 which is received through a threaded bore 80 provided through the inside hinge plate 48. In addition a slightly oversize hole 82 is provided through the outside hinge plate 50 so that bolt 78 can extend through the same. Accordingly, a threaded thumb nut 84 is threadedly received by the bolt 78. In this way, the thumb nut 84 can be turned to bias the two hinge plates 48 and 50 together against a side wall. With this arrangement, the inside and outside hinge plates 48, 50 can pivot from a first open position to receive a side wall of the paint tray therebetween, to a second closed clamping position, as illustrated in FIG. 4, where the inside and outside hinge plates 48, 50 come together to apply clamping pressure to the respective side wall to secure the paint tray carrier 20 to the paint tray 22.

Importantly, it should be noted that many other variations of a clamping device could be employed with equally satisfactory results. All clamps used for such purposes, however are similar in that they would comprise two surfaces that employ a biasing member to provide the clamping pressure. For example, there exists certain clamps (not illustrated) that are configured to be biased by a spring or by the elastic nature of the material comprising the clamp itself. Moreover, as will be more fully described below, one variation of a clamping device comprises inner and outer legs 122, 124 (FIGS. 10 ad 11) that are normally sprung apart wherein a biasing cam 128 is employed to bias the legs together to apply clamping pressure to the side wall of a paint tray 22.

Turning again to FIG. 1, first and second support arms 30, 32 are illustrated in accordance with the present invention. As can be seen, the same are generally rectangular in shape wherein the upper supported ends 32, 40 and lower fastening ends 34, 42 are substantially horizontal and parallel. This construction is well adapted for use with clamps, as noted above, and grip handles as noted below. Further, the body 36, 44 that extends respectively therebetween extends in an upward direction. This construction conveniently eliminates interference of the support arms with a paint roller (not illustrated) employed by the user. Although this construction is acceptable for a preferred embodiment, many other satisfactory configurations could perform equally as well. For example, the first and second support arms 30, 38, or a portion thereof, could be arcuate in shape. Accordingly, the precise shape of the support arms would generally be determined by manufacturing considerations.

Figure 5:
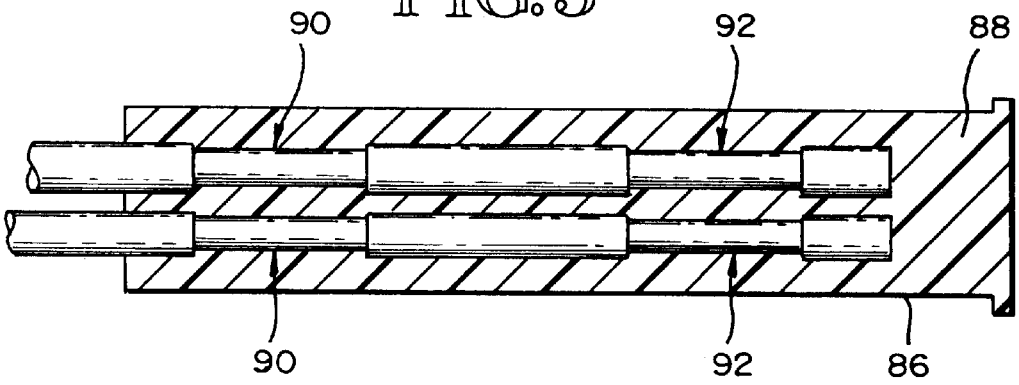
FIG. 5 is a cross-sectional view taken through a grip handle along 5—5 illustrating the upper supported ends of opposing support arms embedded in resin within the grip handle body, wherein the upper supported ends are formed to define radially continuous outer grooves.

Turning now to FIGS. 2 and 5 through 7, a grip handle 86 is illustrated. In the present invention, the grip handle 86 is an ordinary, commercially available, hollow plastic molded grip of the type that could be used to cover a bicycle handle. This type of grip handle is easily adapted to receive the upper supported ends 32, 40 therein. For the purposes of the disclosure of a preferred embodiment, the upper supported ends 32, 40 is that upper portion of the first and second support arms 30, 38 that is horizontally disposed to extend into the grip handle 86. In order to secure the upper supported ends 32–40 within the grip handle 86, a resin 88, such as epoxy, is employed to fill in the voids as illustrated in FIG. 5. FIG. 5 illustrates a preferred embodiment arrangement where the upper supported ends 32, 40 of opposing first and second support arms 30, 38 are embedded in resin 88 within the grip handle 86. In order to secure the upper supported ends from outward slippage, the upper supported ends 32, 40 are formed to define radially continuous outer grooves 90 and 92.

For the purposes of this disclosure, it should be understood that although a bicycle-type grip is employed as noted above, many other similar readily obtainable grips/handles could be substituted with equally satisfactory results. Indeed, any hollow structure that could receive and contain a resin could be used as a grip handle.

Figure 6:
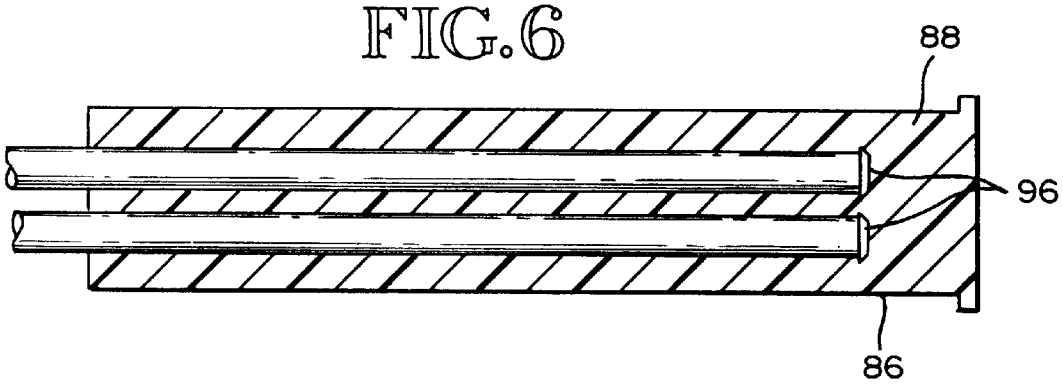
FIG. 6 is a cross-sectional view of a grip handle illustrating a modification where the supported ends of opposing support arms define a barb.
Figure 7:
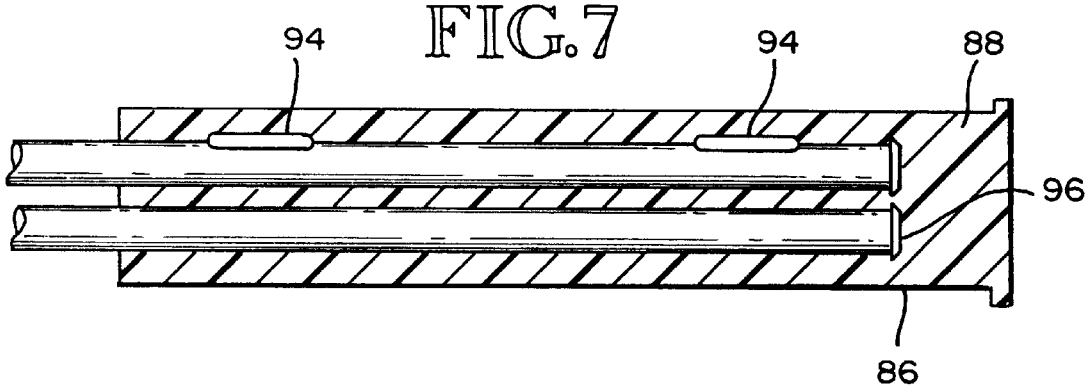
FIG. 7 is a cross-sectional view of a grip handle illustrating a modification where the supported end of one support arm is formed to define a projection, and the supported end of the opposing support arm is formed to define a barb.

Directing attention to FIGS. 6 and 7, alternate embodiments are illustrated. FIG. 6 is a cross-sectional view of a grip handle 86 illustrating a modification where the upper supported ends 32, 40 of opposing support arms define a barb 96 at the end thereof. Like the preferred embodiment, this configuration prevents outward slippage of the upper supported ends 32, 40.

FIG. 7 illustrates an alternate embodiment wherein the upper supported end 32 of one support arm is formed to define a projection 94, and the upper supported end 40 of the opposing support arm is formed to define a barb 96. This arrangement prevents each upper supported end 32, 40 from outward slippage as well as preventing the grip handle 86 from rotating about the upper supported end that is formed to include a projection 94. Accordingly, the first and second support arms 30, 38 are relatively pivotable, yet the grip handle 86 is prevented from rotation. This configuration adds to the stability of a paint tray carrier 20 that is attached to a paint tray 22.

Figure 8:
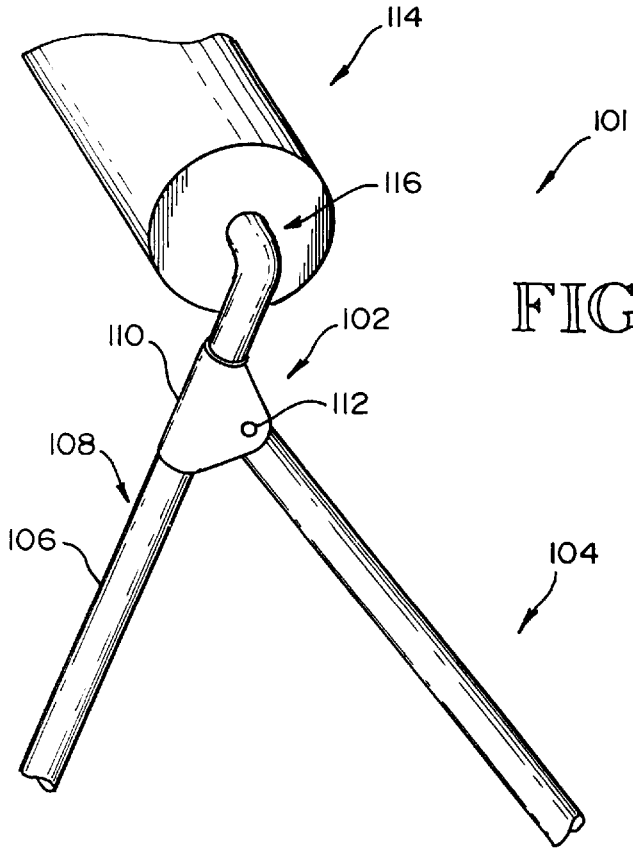
FIG. 8 is an alternate embodiment paint tray carrier illustrating the supported end of one support arm pivotally connected to the body of the opposing support arm.
Figure 9:
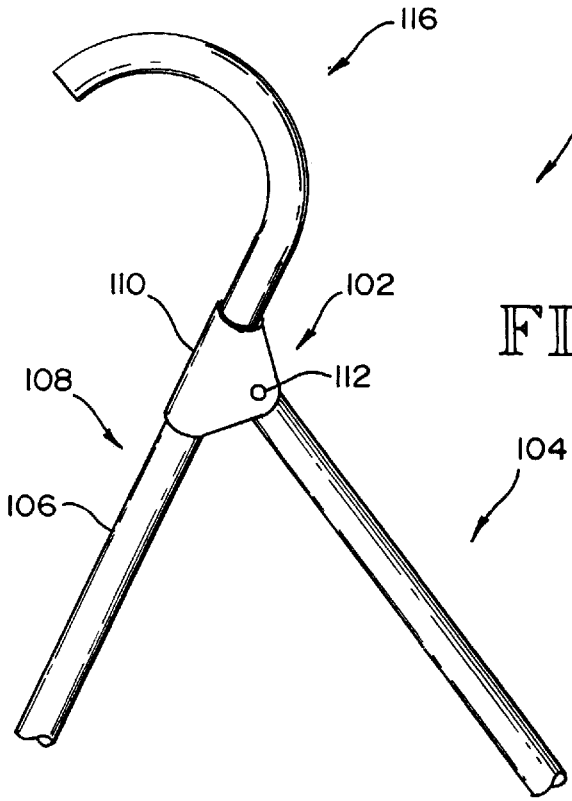
FIG. 9 is an alternate embodiment paint tray carrier, similar to FIG. 8, illustrating the supported end of one support arm pivotally connected to the body of the opposing support arm, wherein the supported end of the opposing support arm is shaped to define a grip handle.

Turning now to FIGS. 8 and 9, an alternate embodiment paint tray carrier 101 is illustrated (in part) where the fastening end 102 of one support arm 104 is pivotally connected to the body 106 of an opposing support arm 108. For this purpose, a pivotal coupler plate 110 is constructed to wrap around the body 106 to receive a hinge pin 112 for pivotally connecting support arm 104 to the body 106. The attachment of the pivotal coupler plate 110 could be in any conventional manner including welding or an interference fit (not illustrated). Additionally, the grip handle 114, and the upper supported end 116 could be constructed as noted above in the preferred embodiment.

Additionally, FIG. 9 is an alternate embodiment paint tray carrier 101, similar to that illustrated in FIG. 8, however no separate grip handle is provided. This embodiment provides that the upper supported end 116 is configured to be the grip handle. Moreover, the upper supported end 116 is curved for comfort of the user.

Figure 10:
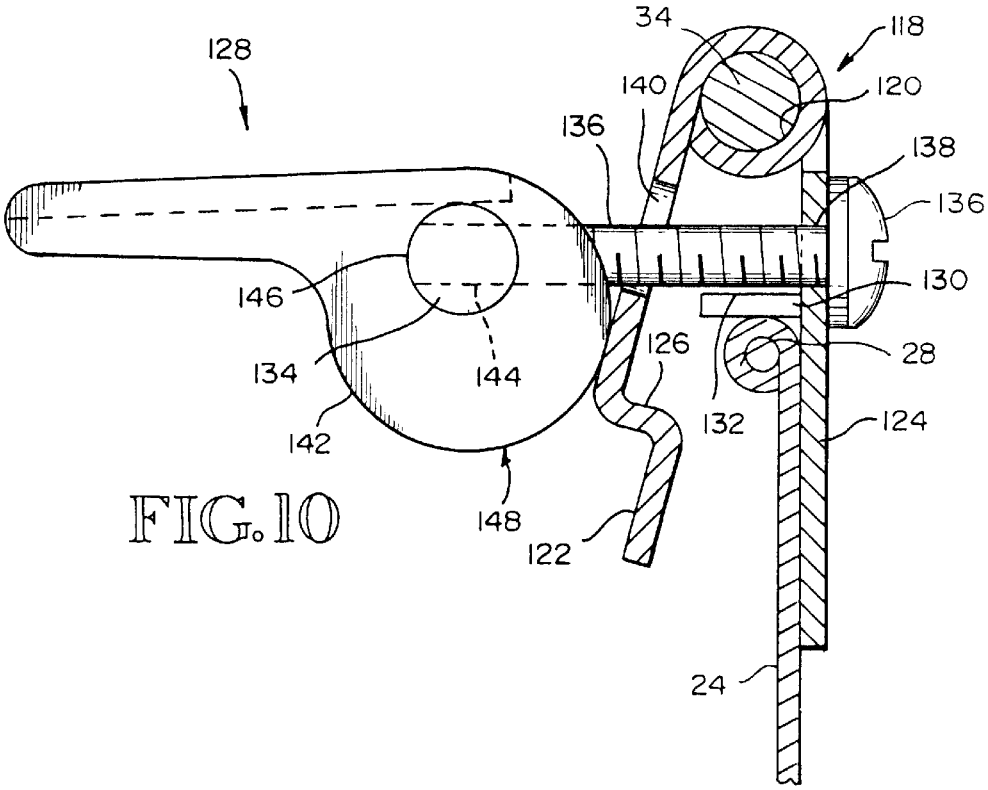
FIG. 10 is a fragmentary cross-sectional view taken through an alternate embodiment spring clamp which is in the first open position to receive a side wall of the paint tray therebetween.
Figure 11:
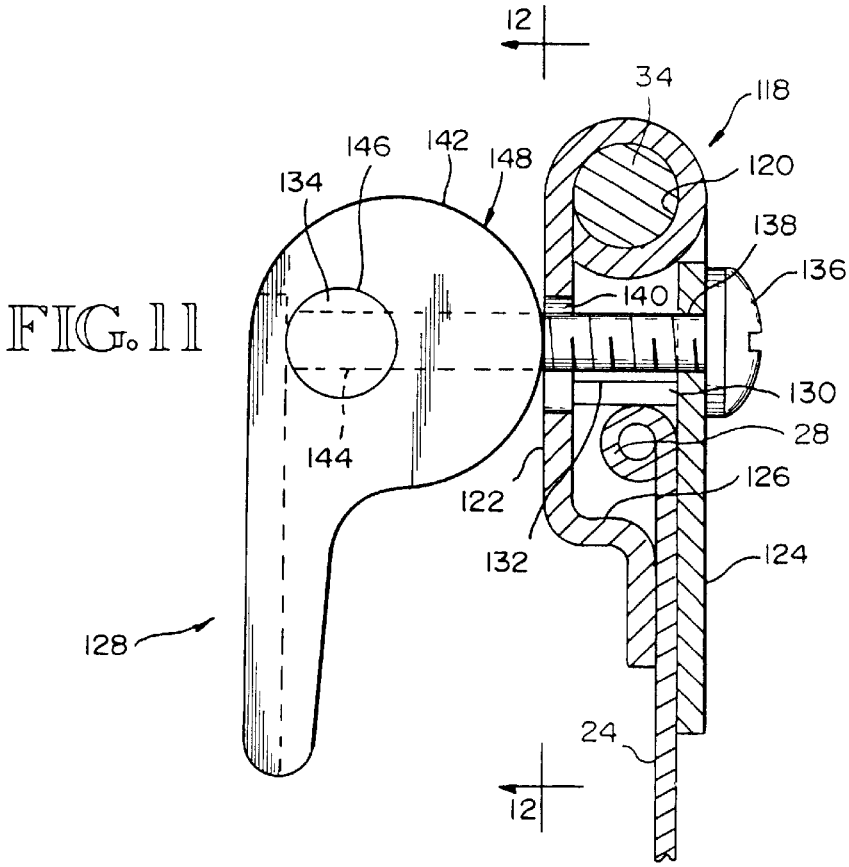
FIG. 11 is a fragmentary cross-sectional view taken through an alternate embodiment spring clamp which is in the second closed clamping position where outer an outer leg and an inner leg come together to apply clamping pressure to the respective side wall to secure the same to the paint tray carrier.
Figure 12:
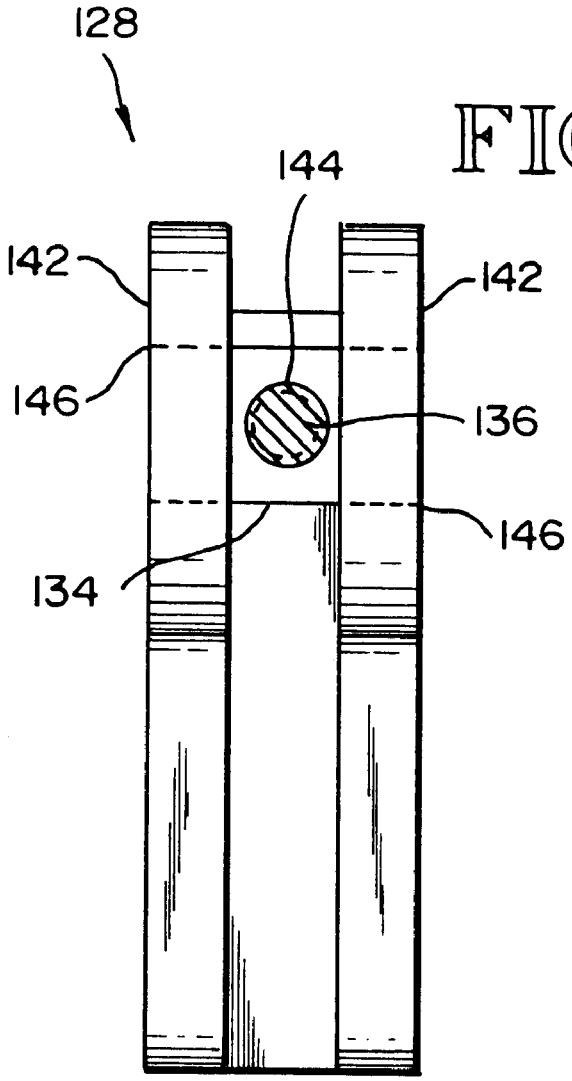
FIG. 12 is an elevational view of a biasing cam taken along 12—12 to illustrate a bolt threadedly received by a pivot pin disposed between two cam lobes.

Turning now to FIGS. 10, 11 and 12, an alternate embodiment is illustrated where a spring clamp 118 is employed to secure the paint tray carrier 20 to a paint tray 22. It should be understood that a spring clamp 118 is provided to perform the same function as the preferred embodiment clamp 46 noted above. For this purpose, a spring clamp 118 is constructed to define a receiving bore 120 which is sized to securely receive a lower fastening end of a support arm. Accordingly, a spring clamp 118 is rotatably mounted to the lower fastening end 34.

The primary difference between a spring clamp 118 and a clamp 46 is that the outer leg 122 and the inner leg 124 of a spring clamp 118 are not relatively pivotable as is the corresponding outside hinge plate 50 and the inside hinge plate 48 of a clamp 46. For this purpose, the outer leg 122 and the inner leg 124 of a spring clamp 118 are normally spaced, i.e., sprung apart, so that a sidewall 24 can be received therebetween.

Importantly, it should be realized that there are many ways to attain this spring-type structure. For example, if the clamp 46 noted above was make from a suitable spring steel, the inside hinge plate 48 and the outside hinge plate 50 thereof could be welded together in a normally open position so that they are not relatively pivotable. Accordingly, a biasing member could be employed to bias the two hinge plates together against a sidewall. Alternatively, an equivalent spring-type structure could be realized by forming, in one piece, spring plate material to define the receiving bore 120, outer leg 122 and inner leg 124. Either construction noted above would perform satisfactorily. Regarding the present disclosure, and in particular FIGS. 10 an 11, the spring clamp 118 illustrated could be achieved by either such construction.

Similar to clamp 46, the spring clamp 118 includes an outer leg 124, which is shaped to define a step 126, and an inner leg 124 which includes a stop lug 130. The stop lug 130 is shaped to define a stop surface 132. In this way, the outer leg 122 and inner leg 124 can be biased against a sidewall with the lip 28 thereof being disposed between the stop surface 132 and the step 126. Accordingly, the sidewall will be secured to the spring clamp 118 and thereby prevented from dislocating.

For the purpose of biasing the outer leg 122 and the inner leg 124 together, a biasing cam 128 is employed. The biasing cam 128 operates like a normal cam, i.e., the biasing cam 128 moves from a first position where it exerts little biasing pressure, to a second position where it exerts maximum biasing pressure.

Specifically, the biasing cam 128 is constructed symmetrically to form two spaced cam lobes 142 through which an eccentrically disposed pin receiving bore 146 is provided. The pin receiving bore 146 is so provided to receive a pivot pin 134. Pivot pin 134 includes a radially disposed, centrally located, threaded bore 144 which is sized to receive bolt 136. Bolt 136 extends from the outside of the inner leg 124 through bore 138. Similarly, bolt 136 extends through opening 140, which is disposed through outer leg 122, wherein bolt 136 is threadedly received by the pivot pin 134. Accordingly, the biasing cam 128, and therefore the cam surface 148 can move from a first position where it exerts little biasing pressure, and where the spring clamp 118 is in a first open position to receive a side wall of the paint tray therebetween, to a second position where the biasing cam 128 exerts maximum biasing pressure, and where the spring clamp 118 is moved to the second closed clamping position where outer leg 122 and the inner leg 124 come together to apply clamping pressure to the respective side wall to secure the same to the paint tray carrier.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. An adjustable paint tray carrier for carrying and transporting a paint tray of the type having substantially parallel, vertically disposed, opposing spaced-apart side walls that define an upper perimeter lip, the tray carrier comprising:

a first support arm having an upper supported end, a spaced-apart lower fastening end and a body disposed therebetween;

an opposing second support arm having an upper supported end, a spaced-apart lower fastening end and a body disposed therebetween, wherein the first support arm is pivotally connected to the second support arm to allow relative pivotal movement such that the distance between the fastening ends of the opposing support arms is variable;

a clamp disposed on the fastening end of the first support arm for connecting the same to a side wall of the paint tray;

a clamp disposed on the fastening end of the second support arm for connecting the same to an opposing side wall of the paint tray; and wherein the support arms are relatively pivotable from a first closed compact position where the fastening ends of the support arms are adjacently disposed, to a second open spread-apart position where each fastening end is disposed adjacent an opposing side wall of the paint tray such that the clamps of each support arm can engage a respective side wall to secure the paint tray carrier to the paint tray.

2. A paint tray carrier as recited in claim 1 wherein the supported end of at least one support arm defines a grip handle sized for grasping by a user thereof.

3. A paint tray carrier as recited in claim 2 wherein the supported end of one support arm is pivotally connected to the body of the opposing support arm.

4. A paint tray carrier as recited in claim 1 wherein the supported end of one support arm is pivotally connected to the body of the opposing support arm.

5. A paint tray carrier as recited in claim 1 wherein the support end of the first support arm is pivotally connected to the support end of the second support arm.

6. A paint tray carrier as recited in claim 5 wherein a grip handle pivotally connects the supported ends of the first and second support arms.

7. A paint tray carrier as recited in claim 1 wherein each clamp comprises opposing inside and outside hinge plates mounted to a respective fastening end of a support arm, wherein at least one hinge plate thereof is pivotally mounted to the fastening end such that the inside and outside hinge plates are relatively pivotable from a first open position to receive a side wall of the paint tray therebetween, to a second closed clamping position where inside and outside hinge plates come together to apply clamping pressure to the respective side wall to secure the same to the paint tray carrier.

8. A paint tray carrier as recited in claim 7 wherein each clamp further comprises a biasing member disposed to urge the left and right legs together.

9. A paint tray carrier as recited in claim 8 wherein the biasing member is a threaded fastener disposed through the left and right legs, wherein the threaded fastener engages an opposing threaded member to urge the left and right legs together.

10. A paint tray carrier as recited in claim 1 wherein each clamp comprises a stop surface to engage a lip of a paint tray sidewall to prevent the same from moving relative to the clamp.

11. A paint tray carrier as recited in claim 1 wherein each clamp comprises opposing outer and inner legs, the clamp being pivotally mounted to a respective fastening end of a support arm, wherein the inner and outer legs assume a normally spaced apart open position so that the same can be biased together from a first open position to receive a side wall of the paint tray therebetween, to a second closed clamping position where left and right legs come together to apply clamping pressure to the respective side wall to secure the same to the paint tray carrier.

12. A paint tray carrier as recited in claim 11 wherein each clamp comprises a biasing cam disposed to move from a first position where the inner and outer legs assume a normally spaced apart open position to receive a side wall of the paint tray therebetween, to a second position where the biasing cam biases the inner and outer legs together thereby urging the inner and outer legs to apply clamping pressure to the respective side wall.

13. A paint tray carrier as recited in claim 11 wherein the inner and outer legs are normally relatively fixed in an open spaced apart position.

14. A paint tray carrier as recited in claim 11 wherein each clamp is pivotable relative to its respective support arm such that relative pivotal movement between support arms allows the same to adapt to trays of varying widths.

15. A paint tray carrier as recited in claim 1 wherein each clamp comprises opposing inside and outside hinge plates wherein at least one hinge plate of each clamp is mounted to a respective fastening end of a support arm, and wherein the inside and outside hinge plates are relatively pivotable from a first open position to receive a side wall of the paint tray therebetween, to a second closed clamping position where inside and outside hinge plates come together to apply clamping pressure to the respective side wall to secure the same to the paint tray carrier.

16. A method for making an adjustable paint tray carrier for carrying and transporting a paint tray of the type having substantially parallel, vertically disposed, opposing spaced-apart side walls that define an upper perimeter lip, the method comprising the steps:

providing a first support arm having an upper supported end, a spaced-apart lower fastening end, and a body disposed therebetween;

providing an opposing second support arm having an upper supported end, a spaced-apart lower fastening end and a body disposed therebetween;

pivotally connecting the first support arm to the second support arm to allow relative pivotal movement such that the distance between the fastening ends of the opposing support arms is variable;

providing a clamp on the fastening end of each support arm for connecting the same to the respective side walls of the paint tray; and wherein the support arms are relatively pivotable from a first closed compact position where the fastening ends of the support arms are adjacently disposed, to a second open spread-apart position where each fastening end is disposed adjacent an opposing side wall of the paint tray such that the clamp of each support arm can engage a respective side wall to secure the paint tray carrier to the paint tray.

17. A method for making an adjustable paint tray carrier as recited in claim 16 wherein the step of providing a clamp further comprises the step of providing opposing inside and outside hinge plates mounted to a respective fastening end of a support arm, wherein at least one hinge plate thereof is pivotally mounted to the fastening end such that the inside and outside hinge plates are relatively pivotable from a first open position to receive a side wall of the paint tray therebetween, to a second closed clamping position where inside and outside hinge plates come together to apply clamping pressure to the respective side wall to secure the same to the paint tray carrier.

18. A paint tray carrier as recited in claim 16 wherein each clamp further comprises a biasing member comprising a threaded fastener disposed through the left and right legs, wherein the threaded fastener engages an opposing threaded member to urge the left and right legs together.

19. An adjustable paint tray carrier for carrying and transporting a paint tray of the type having substantially parallel, vertically disposed, opposing spaced-apart side walls that define an upper perimeter lip, the tray carrier comprising:

a first support arm having an upper supported end, a spaced-apart lower fastening end and a body disposed therebetween;

an opposing second support arm having an upper supported end, a spaced-apart lower fastening end and a body disposed therebetween, wherein the first support arm is pivotally connected to the second support arm to allow relative pivotal movement such that the distance between the fastening ends of the opposing support arms is variable;

a clamp disposed on the fastening end of the first support arm for connecting the same to a side wall of the paint tray;

a clamp disposed on the fastening end of the second support arm for connecting the same to an opposing side wall of the paint tray;

wherein each clamp comprises opposing outer and inner legs with at least one clamp being pivotally mounted to a respective fastening end of a support arm, wherein the inner and outer legs assume a normally spaced apart open position so that the same can be biased together from a first open position to receive a side wall of the paint tray therebetween, to a second closed clamping position where left and right legs come together to apply clamping pressure to the respective side wall to secure the same to the paint tray carrier; and wherein the support arms are relatively pivotable from a first closed compact position where the fastening ends of the support arms are adjacently disposed, to a second open spread-apart position where each fastening end is disposed adjacent an opposing side wall of the paint tray such that the clamps of each support arm can engage a respective side wall to secure the paint tray carrier to the paint tray.

20. A paint tray carrier as recited in claim 19 wherein each clamp comprises a biasing cam disposed to move from a first position where the inner and outer legs assume a normally spaced apart open position to receive a side wall of the paint tray therebetween, to a second position where the biasing cam biases the inner and outer legs together thereby urging the inner and outer legs to apply clamping pressure to the respective side wall.

* * * * *